US005360193A

United States Patent [19]

Cobb

[11] Patent Number: 5,360,193

[45] Date of Patent: Nov. 1, 1994

[54] DETACHABLE HANGING PLANT SUPPORT

[76] Inventor: David E. Cobb, 3920 Washakie, Casper, Wyo. 82609

[21] Appl. No.: 157,976

[22] Filed: Nov. 29, 1993

[51] Int. Cl.[5] ..... A47H 1/10

[52] U.S. Cl. ..... 248/318; 47/67

[58] Field of Search ..... 248/318, 322, 312.1; 47/67; 211/113; 294/82.17

[56] References Cited

U.S. PATENT DOCUMENTS

| | | | |
|---|---|---|---|
| 246,145 | 8/1881 | Keil . | |
| 951,684 | 3/1910 | Gillespie | 47/67 |
| 1,154,627 | 9/1915 | Hall . | |
| 1,484,403 | 2/1924 | Miller | 47/67 |
| 1,527,281 | 2/1925 | Stapfer | 294/82.17 X |
| 2,530,456 | 11/1950 | Fracchia . | |
| 3,981,099 | 9/1976 | Dziewulski . | |
| 4,032,102 | 6/1977 | Wolf . | |
| 4,159,094 | 6/1979 | Stekoll | 248/318 |
| 4,262,873 | 4/1981 | Prenger | 248/318 |
| 4,337,916 | 7/1982 | Norris | 248/318 X |
| 4,349,172 | 9/1982 | Banks | 248/322 |
| 4,506,475 | 3/1985 | Elliott | 47/67 |

*Primary Examiner*—J. Franklin Foss
*Attorney, Agent, or Firm*—Risto A. Rinne, Jr.

[57] ABSTRACT

An apparatus for suspending a hanging plant that is housed in a container is described as including three or more flexible supports each of which has a first end and a second end. The first end of each flexible support is adapted for hanging from an overhead supporting hook. The second end of each flexible support is attached together to provide an enclosure for retaining and for supporting the container. At least one of the flexible supports includes a fastener that is disposed intermediate to the first end and the second end. The fastener includes a slideable sleeve. The slideable sleeve can be displaced along the longitudinal axis of the flexible support to expose a coupling which can then be separated. Once the coupling is separated the flexible support also separates into two halves and the container can be readily removed from or inserted into the apparatus through the opening provided by the separated flexible support. When the slideable sleeve is displaced so as to cover the coupling, the coupling is thereby prevented from decoupling.

18 Claims, 1 Drawing Sheet

DETACHABLE HANGING PLANT SUPPORT

BACKGROUND OF THE INVENTION

1. Field of the Invention

The present invention, in general, relates to apparatus used for suspending plants and, more particularly, to devices for hanging potted plants which allow for the ready removal of the potted plants therefrom.

Hanging supports for potted plants are well known. However, as plants grow they periodically need to be transplanted (re-potted) into larger vessels. As the branches and shoots also grow, they tend to become entangled with the hanging support as well.

This makes removal of the potted plant from the hanging support difficult to accomplish, and also introduces an increased element of risk that the plant may be damaged during removal from the hanging support or during installation back into the hanging support.

In fact, occasionally some plants develop growth that actually wraps entirely around certain of the supports so that removal of the hanging support away from the plant, as is necessary for the re-potting of the plant, becomes impossible to accomplish without also having to sever certain of the shoots.

Also, during periodic decorating of homes and businesses, the need to move certain plants from their hanging supports and to substitute other plants in those hanging supports, arises.

Accordingly there exists today a need for a detachable hanging plant support for potted plants that allows for the easy removal or installation of potted plants apart from the hanging plant support without causing damage to the plant.

2. Description of Prior Art

Hanging supports for potted plants are, in general, known. For example, the following patents describe various types of these devices:

U.S. Pat. No. 951,684 to Gillespie, Mar. 8, 1910;
U.S. Pat. No. 1,154,627 to Hall, Sep. 28, 1915;
U.S. Pat. No. 2,530,456 to Fracchia, Nov. 21, 1950;
U.S. Pat. No. 3,981,099 to Dziewulski, Sep. 21, 1976;
U.S. Pat. No. 4,032,102 to Wolf et al, Jun. 28, 1977;
U.S. Pat. No. 4,506,475 to Elliott, Mar. 26, 1985;
U.S. Des. Pat. No. 246,145 to Hendricks, Oct. 25, 1977;
and U.K. Pat. No. 4647 to Thoolen, Oct. 7, 1909.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an important object of the present invention to provide a detachable hanging plant support that is easy to insert potted plants into.

It is also an object of the invention to provide a detachable hanging plant support that is easy to remove potted plants from.

Another object of the invention is to provide a detachable hanging plant support that is inexpensive to manufacture.

Still another object of the invention is to provide a detachable hanging plant support that is easy to use.

Yet another object of the invention is to provide a detachable hanging plant support that provides a method to prevent the accidental detachment of plants from the support.

Still yet another important object of the invention is to provide a detachable hanging plant support that prevents damage from occurring to plants when they are removed from the support.

Briefly, a detachable hanging plant support for use with potted plants that is constructed in accordance with the principles of the present invention has a plurality of flexible supports each of which has a first end and a second end. The first end of each flexible support is adapted for suspension from any preferred type of overhead supporting attachment. The second ends of each of the flexible supports are attached together and generally enclose from the sides, and support from the bottom, the potted plant. One or more of the flexible supports includes a fastener that is disposed intermediate the first end and the second end thereof. The fastener includes a slideable sleeve which is displaced longitudinally along the axis of the flexible support thereby providing access sufficient to permit decoupling of the fastener into two halves. When the two halves of the fastener are attached together, the slideable sleeve is displaced longitudinally to cover the fastener and to prevent any decoupling thereof from occurring inadvertently.

DETAILED DESCRIPTION OF THE INVENTION

Figure 1:
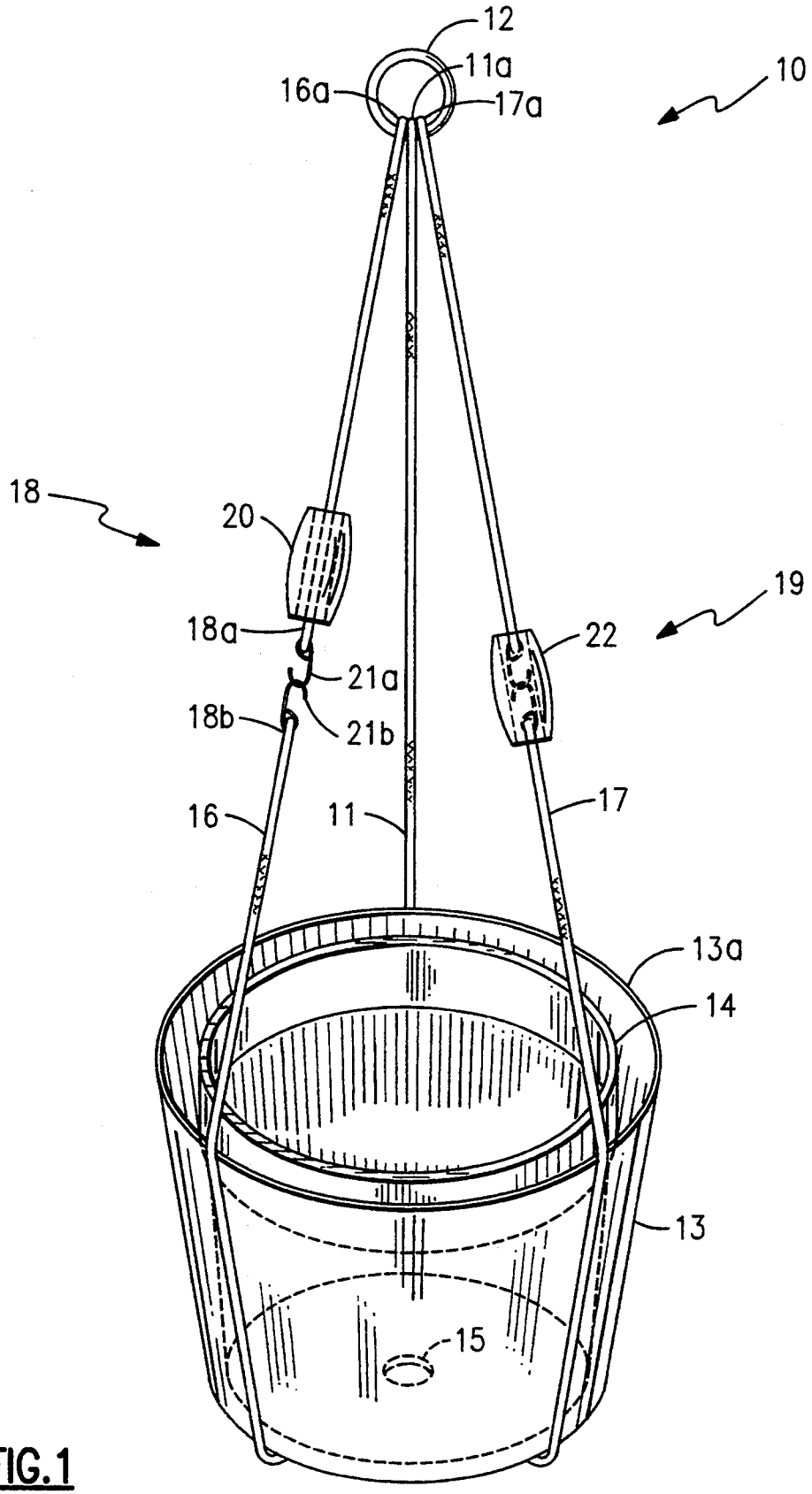
FIG. 1 is a view in perspective of a detachable hanging plant support.

Referring to FIG. 1 is shown, a detachable hanging plant support, identified in general by the reference numeral 10.

A first end 11a of a first flexible support 11 is attached to a support ring 12 and extends down and around the exterior of an outer basket 13 which houses an inner pot 14. The outer basket 13 and the inner pot 14 are separate components with respect to the detachable hanging plant support 10, but are included to provide a more complete description and understanding thereof.

A plant (not shown) or a small shrub (not shown) is normally placed inside of the inner pot 14 but is omitted from the FIG. 1 drawing to provide improved clarity of view of the construction of the detachable hanging plant support 10.

If preferred, the outer basket 13 is eliminated and the detachable hanging plant support 10 is used to provide support directly (only) for the inner pot 14. However the outer basket 13 is usually considered to be more decorative than is the inner pot 14 and its use is therefore often preferred for the housing of the inner pot 14.

Also, the outer basket 13 serves to retain the irrigation water (not shown) that is applied to the plant in the inner pot 14, the excess of which seeps out of a hole 15 present at the inner pot 14 bottom.

A second end (not shown) of the first flexible support 11 is attached to a second ring (not shown) that is placed in the center and underneath of the outer basket 13. A second end (not shown) of a second flexible support 16 and a second end (not shown) of a third flexible support 17 also are attached to the second ring.

If preferred the second ring is eliminated and the second ends of the first, second, and third flexible supports 11, 16, 17 are either tied, woven, or braided together underneath the outer basket 13.

To provide stability to the inner pot 14 and the outer basket 13, a minimum of three flexible supports 11, 16, 17, are required. It is anticipated that more than three flexible supports (not shown) are used when preferred for aesthetic or for functional reasons. For example, to support a very heavy plant several additional flexible supports (not shown) are used.

The first, second, and third flexible supports 11, 16, 17 are constructed of any flexible material, including but not limited to string, rope, braid, cable, and chain. It is a requirement that they be formed of a flexible material, the use thereof is discussed in greater detail hereinbelow.

As shown, a first end of the second flexible support 16*a*, a first end of the third flexible support 17*a*, and the first end of the first flexible supports 11*a* are each attached to the ring 12. The ring 12 is then suspended from a ceiling hook (not shown) that is placed at an elevation higher than that where the detachable hanging plant support 10 is to be suspended.

One of the purposes accomplished by the first, second, and third flexible supports 11, 16, 17 is to enclose and to provide support for the outer basket 13 directly, and therefore also for the inner pot 14, and any plant which may be housed therein.

If preferred, the first end of each of the three flexible supports 11*a*, 16*a*, 17*a* is instead attached to its own support ring (not shown) and each of the three support rings are suspended from either the same ceiling hook or from a plurality of ceiling hooks (not shown).

The first flexible support 11, as shown, extends continuously from the ring 12 to the second ring located under the center of the outer basket 13.

The second flexible support 16 includes a first fastener, identified in general by the reference numeral 18, that is disposed intermediate a top of the outer basket 13*a* and the first end of the second flexible support 16*a*.

The third flexible support 17 includes a second fastener, identified in general by the reference numeral 19, that is disposed intermediate the top of the outer basket 13*a* and the first end of the third flexible support 17*a*.

The first fastener 18 includes a first slideable sleeve 20 which is shown as having been displaced longitudinally along the axis of the second flexible support 16 to provide access sufficient for detaching the first fastener 18 apart thereby separating the second flexible support 16 into two halves consisting of an upper half 18*a* and a lower half 18*b*.

The upper half 18*a* and the lower half attach together by a pair of hooks 21*a*, 21*b*. As shown in the FIG. 1 drawing, the upper half 18*a* and the lower 18*b* are exposed and can be separated apart as desired, but are presently coupled together by the pair of hooks 21*a*, 21*b*.

When the first slideable sleeve 20 is displaced as shown, the pair of hooks 21*a*, 21*b* are easily separated apart from each other (decoupled) and accordingly the first fastener 18 is easily separated apart into the upper half 18*a* and the lower half 18*b*.

The upper half 18*a* is pulled up and away from the plant and the lower half 18*b* is easily pulled down and through any plant foliage (not shown) without causing any damage to the plant. The outer basket 13, the inner pot 14, and any plant located therein is then removed apart from the detachable hanging plant support 10.

The invention, as disclosed includes both the first fastener 18 and the second fastener 19. At a minimum only one fastener (the first fastener 18) is required which is attached intermediate to the second flexible support 16.

If preferred a plurality of fasteners (not shown) in excess of the two that are described herein are used which make either the installation or the removal of the outer basket 13, inner pot 14, and plant with respect to the detachable hanging plant support 10 generally even easier to accomplish.

The maximum number of the plurality of fasteners which may be used is the same as the quantity of flexible supports which form the detachable hanging plant support 10. Therefore, if desired, the first flexible support 11 is also constructed so as to include an auxiliary fastener (not shown) that is located intermediate its first end 11*a* and the top of the outer basket 13*a*.

The first fastener 18 and the second fastener 19 are disposed at a location intermediate the first ends 16*a*, 17*a* and the second ends of each of the second and third flexible supports 16, 17 respectively at a preferred location for decoupling the flexible supports 16, 17 into their two halves (18*a*, and 18*b* for second flexible support 16).

The intermediate location as chosen allows for the shortest possible length for that portion of each of the two halves 18*a*, 18*b* of the second flexible support 16 (and all other flexible supports which also include a fastener) which must separated apart from the plant itself. The short length for each of the two halves 18*a* 18*b* is preferred as they must each be pulled through the foliage and separated apart from the plant in order to allow for the safe removal of the plant apart from the detachable hanging plant support 10.

The first slideable sleeve 20 must be displaced sufficiently far longitudinally along the axis of the second flexible support 16 to expose the pair of hooks 21*a*, 21*b* for detachment to occur. When the outer basket 13 (i.e. the plant) is inserted into the detachable hanging plant support 10 inadvertent detachment of the first fastener 18 into the upper half 18*a* apart from the lower half 18*b* is not desired, for this could result in the accidental release of the outer basket 13 from a position of cooperation with the detachable hanging plant support 10. Such accidental release would likely damage any plant thus supported during a fall to the ground.

Accordingly to prevent the accidental separation of the first fastener 18 into the upper half 18*a* apart from the lower half 18*b* from occurring, the first slideable sleeve 20 must be displaced sufficiently far longitudinally along the axis of the second flexible support 16 to cover the pair of hooks 21*a*, 21*b*.

When the pair of hooks 21*a*, 21*b* are covered by the first slideable sleeve 20, the pair of hooks 21*a*, 21*b* are maintained in a position of cooperation with respect to each other and cannot be accidentally separated apart if the first slideable sleeve 20 or any other portion of the second flexible support 16 is inadvertently bumped or pushed.

While the pair of hooks 21*a*, 21*b* are preferred, many other methods useful to couple the upper half 18*a* and the lower half 18*b* together are anticipated. For example a hook and eye (not shown) is substituted for the pair of hooks 21*a*, 21*b* as desired.

When a modified type of coupling device (not shown) is used to fasten the upper half 18*a* and the lower half 18*b* together, it must be constructed so as to permit detachment of the upper half 18*a* apart from the lower half 18*b* when the first slideable sleeve 20 is displaced sufficiently far longitudinally along the length of the second flexible support 16 to expose the modified type of coupling device.

It must also maintain the upper half 18*a* and the lower half 18*b* in cooperation together when the first slideable sleeve 20 is displaced sufficiently far so as to cover the modified type of coupling device.

The second fastener 19 is constructed similar to the first fastener 18 as are any of a plurality of fasteners (not shown) if included in the construction of the detachable hanging plant support 10. A second slideable sleeve 22 is shown in the normally closed position which ensures that the second fastener 19 of the third flexible support 17 cannot be separated apart into two halves.

The invention has been shown, described and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A detachable hanging plant support for supporting a plant in a container, comprising:

flexible means adapted for supporting said container, said flexible means including more than two of said flexible means, and each of said flexible means having a first end and a second end;

said first end of each of said flexible means attached to means for suspending said detachable hanging plant support;

said second end of each of said flexible means being attached together and adapted for enclosing and supporting said container;

means adapted for separating at least one of said flexible means apart into tow halves, said means adapted for separating being disposed intermediate to said first end and to said second end of said at least one of said flexible means; and means for preventing said means adapted for separating from inadvertently separating apart into said two halves;

whereby said means for preventing includes a first position and a second position, wherein when said means for preventing is urged into said first position said means for preventing prohibits any separation of said means adapted for separating from occuring, and when said means for preventing is urged into said second position said means for preventing allows for the separation by said means adapted for separating to occur.

2. The detachable hanging plant support of claim 1, wherein said means for suspending includes a ring, and said first end of each of said flexible means is attached to said ring.

3. The detachable hanging plant support of claim 1, wherein said means for suspending includes a plurality of rings, and said first end of each of said flexible means is attached to each of said plurality of rings.

4. The detachable hanging plant support of claim 1, wherein said second end of each of said flexible means is attached to a lower ring.

5. The detachable hanging plant support of claim 1, wherein said means adapted for separating includes a first hook attached to one of said two halves and a second hook attached to the remainder of said two halves, said first and second hooks being adapted for cooperating together to couple said first and second halves together and for separating said first and second halves apart from each other.

6. The detachable hanging plant support of claim 1, wherein said means adapted for separating includes a first hook attached to one of said two halves and a first eye attached to the remainder of said two halves, said first hook and said first eye being adapted for cooperating together to connect said first and second halves together and for separating said first and second halves apart from each other.

7. The detachable hanging plant support of claim 1, wherein said means adapted for separating includes fastening means for attaching said first half to said second half and for separating said first half apart from said second half.

8. The detachable hanging plant support of claim 1, wherein said means for preventing includes slideable sleeve means adapted for covering said means adapted for separating to prevent any separation thereof.

9. The detachable hanging plant support of claim 8, wherein said slideable sleeve means is adapted for urging into a first position to substantially enclose said means adapted for separating sufficient to prevent any separation thereof, and said slideable sleeve means is adapted for urging into a second position to substantially expose said means adapted for separating sufficient to permit the separation thereof.

10. A detachable hanging plant support for supporting a plant in a container, comprising:

flexible means adapted for supporting said container, said flexible means including more than two of said flexible means, and each of said flexible means having a first end and a second end;

said first end of each of said flexible means attached to means for suspending said detachable hanging plant support;

said second end of each of said flexible means being attached together and adapted for enclosing and supporting said container;

means adapted for separating at least one of said flexible means apart into two halves, said means adapted for separating being disposed intermediate to said first end and to said second end of said at least one of said flexible means; and means for preventing said means adapted for separating from inadvertently separating apart into said two halves;

whereby said means for preventing includes a first position and a second position, wherein when said means for preventing is urged into said first position, said means for preventing substantially encloses said means adapted for separating sufficient to prevent the separation thereof, and when said means for preventing is urged into said second position, said means for preventing substantially exposes said means adapted for separating sufficient to permit the separation thereof.

11. The detachable hanging plant support of claim 10, wherein said means for suspending includes a ring, and said first end of each of said flexible means is attached to said ring.

12. The detachable hanging plant support of claim 10, wherein said means for suspending includes a plurality of rings, and said first end of each of said flexible means is attached to each of said plurality of rings.

13. The detachable hanging plant support of claim 10, wherein said second end of each of said flexible means is attached to a lower ring.

14. The detachable hanging plant support of claim 10, wherein said means adapted for separating includes a first hook attached to one of said two halves and a second hook attached to the remainder of said two halves, said first and second hooks being adapted for cooperating together to couple said first and second halves together and for separating said first and second halves apart from each other.

15. The detachable hanging plant support of claim 10, wherein said means adapted for separating includes a first hook attached to one of said two halves and a first eye attached to the remainder of said two halves, said first hook and said first eye being adapted for cooperating together to connect said first and second halves together and for separating said first and second halves apart from each other.

16. The detachable hanging plant support of claim 10, wherein said means adapted for separating includes fastening means for attaching said first half to said second half and for separating said first half apart from said second half.

17. The detachable hanging plant support of claim 10, wherein said means for preventing includes slideable sleeve means adapted for covering said means adapted for separating to prevent any separation thereof.

18. The detachable hanging plant support of claim 17, wherein said slideable sleeve means is adapted for urging into said first position to substantially enclose said means adapted for separating sufficient to prevent any separation thereof, and said slideable sleeve means is adapted for urging into said second position to substantially expose said means adapted for separating sufficient to permit the separation thereof.

* * * * *